US011667508B2

(12) United States Patent
Abeygunawardana et al.

(10) Patent No.: US 11,667,508 B2
(45) Date of Patent: Jun. 6, 2023

(54) BEVERAGE DISPENSER WITH DRIP TRAY DETECTION

(71) Applicant: Haier US Appliance Solutions, Inc., Wilmington, DE (US)

(72) Inventors: Danister Abeygunawardana, Jeffersonville, IN (US); Jianwu Li, Louisville, KY (US); Gregory Scott Carr, Louisville, KY (US); Brent Alden Junge, Evansville, IN (US); Jordan Andrew Waymeyer, Louisville, KY (US); Timothy Ray Jackson, Louisville, KY (US); Michael C. Watanabe, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/458,662

(22) Filed: Aug. 27, 2021

(65) Prior Publication Data

US 2023/0068466 A1 Mar. 2, 2023

(51) Int. Cl.
*B67D 1/08* (2006.01)
*B67D 1/16* (2006.01)

(52) U.S. Cl.
CPC ..... *B67D 1/0888* (2013.01); *B67D 1/16* (2013.01)

(58) Field of Classification Search
CPC ..... B67D 1/0888; B67D 1/16
See application file for complete search history.

(56) References Cited

U.S. PATENT DOCUMENTS

| | | | | |
|---|---|---|---|---|
| 5,245,915 | A * | 9/1993 | Ford | A47J 31/44 210/477 |
| 9,173,519 | B2 | 11/2015 | Gregory | |
| 9,675,205 | B2 | 6/2017 | Francois | |
| 10,064,515 | B2 | 9/2018 | McCormich | |
| 10,690,398 | B2 | 6/2020 | Siyeon | |
| 2005/0279216 | A1* | 12/2005 | Miller | A47J 31/106 99/279 |
| 2009/0096967 | A1* | 4/2009 | Sung | G09G 3/3611 349/114 |
| 2015/0144651 | A1* | 5/2015 | Berger | B67D 1/0014 222/173 |
| 2018/0268358 | A1* | 9/2018 | Alden | G07C 9/00174 |
| 2020/0029725 | A1* | 1/2020 | Wantland | F25D 23/126 |

FOREIGN PATENT DOCUMENTS

| | | | | |
|---|---|---|---|---|
| DE | 102010023668 | A1 * | 12/2010 | A47J 31/44 |
| DE | 202013003918 | U1 | 5/2013 | |
| DE | 202013003918 | U1 * | 7/2013 | A47J 31/4482 |
| WO | WO-2015110128 | A1 * | 7/2015 | A47J 31/4428 |
| WO | WO2015110128 | A1 | 7/2015 | |

* cited by examiner

*Primary Examiner* — Donnell A Long
(74) *Attorney, Agent, or Firm* — Dority & Manning, P.A.

(57) ABSTRACT

A beverage dispenser includes a casing defining a dispensing recess and a plurality of mounting pockets. The plurality of mounting pockets are distributed along a vertical direction at the dispensing recess. A fluid conduit is disposed within the casing. An outlet of the fluid conduit is disposed above the dispensing recess of the casing. A drip tray is mountable to the casing at each of the plurality of mounting pockets. A plurality of sensors is disposed within the casing. Each of the plurality of sensors is positioned at a respective one of the plurality of mounting pockets. Each of the plurality of sensors configured to detect when the drip tray is mounted at the respective one of the plurality of mounting pockets.

20 Claims, 5 Drawing Sheets

BEVERAGE DISPENSER WITH DRIP TRAY DETECTION

FIELD OF THE INVENTION

The present subject matter relates generally to beverage dispensers and, more particularly, to beverage dispensers with drip trays.

BACKGROUND OF THE INVENTION

Known beverage dispensers include an autofill function that automatically dispenses liquid. Drip trays can help manage splashes, drips, and spill in beverage dispensers with autofill functions. For example, the drip tray can catch dispensed liquid when a container is improperly placed and/or removed early. Thus, a properly installed drip tray facilitates operation of beverage dispensers.

BRIEF DESCRIPTION OF THE INVENTION

Aspects and advantages of the invention will be set forth in part in the following description, or may be obvious from the description, or may be learned through practice of the invention.

In one example aspect of the present disclosure, a beverage dispenser includes a casing that defines a dispensing recess and a plurality of mounting pockets. The plurality of mounting pockets are distributed along a vertical direction at the dispensing recess. A fluid conduit is disposed within the casing. An outlet of the fluid conduit is disposed above the dispensing recess of the casing. A drip tray is mountable to the casing at each of the plurality of mounting pockets. A plurality of sensors is disposed within the casing. Each of the plurality of sensors is positioned at a respective one of the plurality of mounting pockets. Each of the plurality of sensors configured to detect when the drip tray is mounted at the respective one of the plurality of mounting pockets.

In another example aspect of the present disclosure, a beverage dispenser includes a casing that defines a dispensing recess and a plurality of mounting pockets. The plurality of mounting pockets are distributed along a vertical direction at the dispensing recess. A fluid conduit is disposed within the casing. An outlet of the fluid conduit disposed above the dispensing recess of the casing. A drip tray is mountable to the casing at each of the plurality of mounting pockets such that a magnet within the drip tray is disposed within the respective mounting pocket. A plurality of magnetic sensors is disposed within the casing. Each of the plurality of magnetic sensors positioned at a respective one of the plurality of mounting pockets. Each of the plurality of magnetic sensors is configured to detect the magnet when the drip tray is mounted at the respective one of the plurality of mounting pockets.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
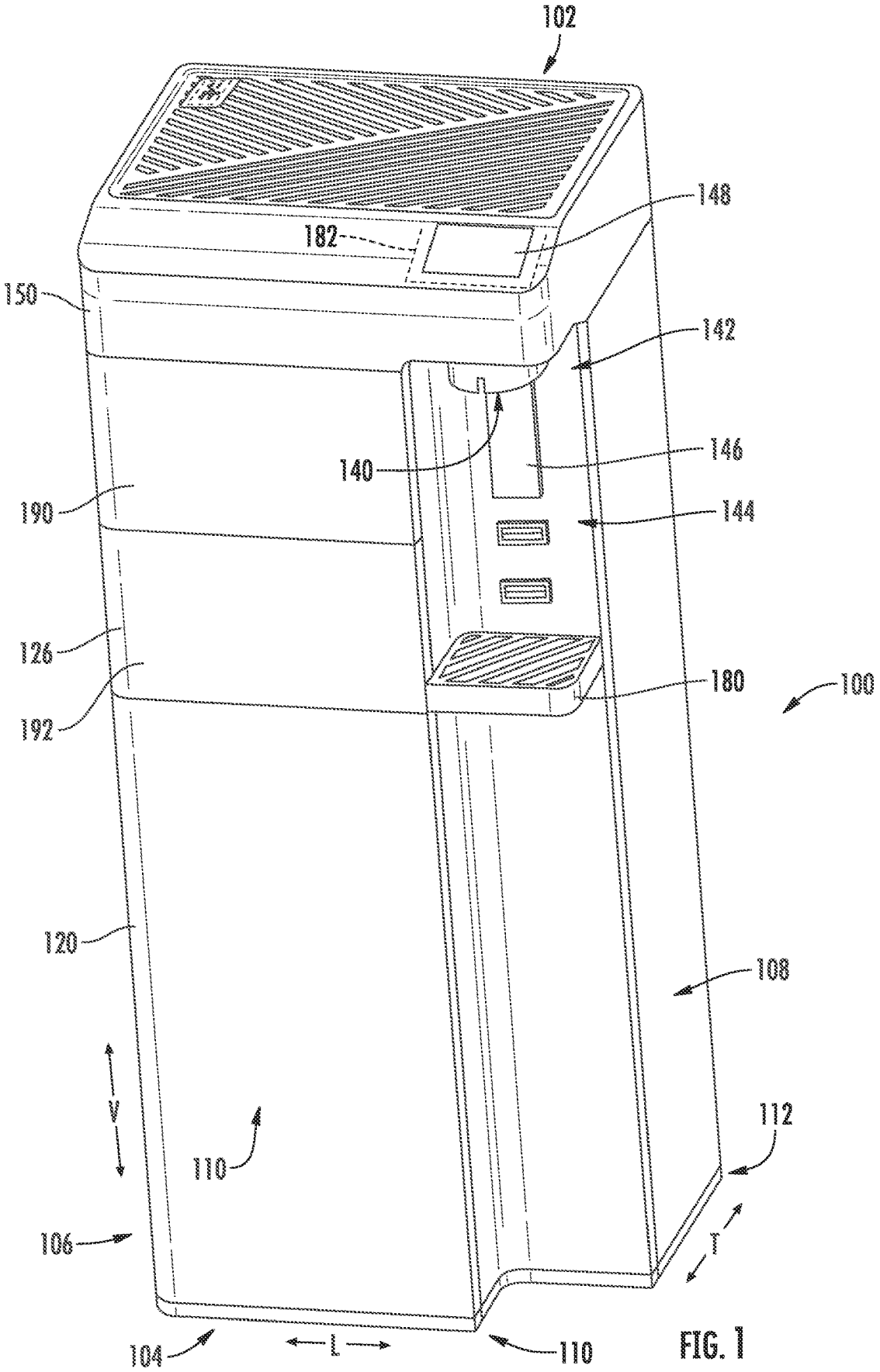
FIG. 1 is a front perspective view of a free-standing appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative position with respect to a fluid flow along a fluid pathway. For example, "upstream" may refer to a position that is closer to an entrance of the fluid flow along the fluid pathway, and "downstream" may refer to a position that is closer to an exit of the fluid flow along the fluid pathway.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

FIG. 1 shows a free-standing appliance 100 with a cabinet or housing 120 that extends between a top 102 and a bottom 104 along a vertical direction V; between a first side 106 and a second side 108 along a lateral direction L; and between a front 110 and a back 112 along a transverse direction T. Each of the vertical direction V, lateral direction L, and transverse direction T are mutually perpendicular and thus form an orthogonal direction system. It will be understood that, while described in greater detail below in the context of free-standing appliance 100, the present subject matter may be used in or with any suitable beverage dispenser in alternative example embodiments.

Cabinet 120 supports or houses various components of free-standing appliance 100 to produce ice or dispense one more liquids, e.g., beverages, using a water source, such as a refillable internal water tank, e.g., removably held within cabinet 120. For instance, an icemaker may be mounted within cabinet 120 downstream from water tank 170 to receive water therefrom and form ice, which may be supplied to a downstream ice bin 126 disposed within the cabinet 120. Additionally or alternatively, one or more water lines, such as a cold water line, a hot water line, or a carbonated water line, may be mounted to and/or within cabinet 120 downstream from the water tank to selectively dispense liquid(s) from one or more corresponding outlets. In certain example embodiments, the icemaker may be a nugget icemaker, such as the nugget icemaker described in U.S. Pat. No. 10,578,346, which is incorporated by reference in its entirety for all purposes.

Free-standing appliance 100 includes a delivery assembly 142 for delivering or dispensing one or more liquids, such as cold water, hot water, or carbonated water, from one or more outlets 140. A brewing module 143 (FIG. 2), such as a single-serve brewing module, may be mountable to housing 120 at outlets 140. In some embodiments, a dispenser recess 144 is defined below one or more of the outlets 140. Additionally or alternatively, an actuating mechanism 146, shown as a paddle, may be mounted below the outlet(s) 140, e.g., within dispenser recess 144, for operating delivery assembly 142. In alternative exemplary embodiments, any suitable actuating mechanism 146 may be used to operate delivery assembly 142. For example, delivery assembly 142 can include a sensor, such as an ultrasonic sensor, or a button rather than the paddle. In certain embodiments, a control panel 148 is provided, e.g., mounted to a top panel 150 of cabinet 120, for controlling the mode of operation. For example, control panel 148 may include a plurality of user inputs (not labeled), such as one or more buttons, knobs, or graphical user interfaces, e.g., presented on a touchscreen display, for selecting a desired mode of operation or beverage to be dispensed.

Operation of the free-standing appliance 100 can be regulated by a controller 152 that is operatively coupled to control panel 148 or various other components, as will be described below. Generally, in response to user manipulation of control panel 148 or one or more sensor signals, controller 152 may operate various components of the free-standing appliance 100. Controller 152 may include a memory and one or more microprocessors, CPUs or the like, such as general or special purpose microprocessors operable to execute programming instructions or micro-control code associated with operation of free-standing appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 152 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 152 may be positioned in a variety of locations throughout free-standing appliance 100. In the illustrated embodiments, controller 152 is located within top panel 150. In other embodiments, the controller 152 may be positioned at any suitable location within cabinet 120. Input/output ("I/O") signals may be routed between controller 152 and various operational components of free-standing appliance 100. For example, control panel 148 and delivery assembly 142 may be in communication with controller 152 via one or more signal lines or shared communication busses. Additionally or alternatively, controller 152 may be in communication with various other components of free-standing appliance 100. For example, various valves, switches, light sources, etc. may be actuatable based on commands from the controller 152. As discussed, control panel 148 may additionally be in communication with the controller 152. Thus, the various operations may occur based on user input or automatically through controller 152 instruction.

In optional embodiments, a power receptacle 154 having one or more electrical outlet plugs, e.g., standard 3-prong outlets, may be mounted to cabinet 120, e.g., at top panel 150. An electrical device, such as a coffee grinder or phone charger, having a mating inlet plug may selectively connect and disconnect from power receptacle 154.

Although free-standing appliance 100 is not limited to any specific shape or dimensions, free-standing appliance 100 may generally be sized to fit within a fairly small room, such as an office breakroom, commercial kitchen, or in place of a so-called water cooler (i.e., fountain).

Figure 2:
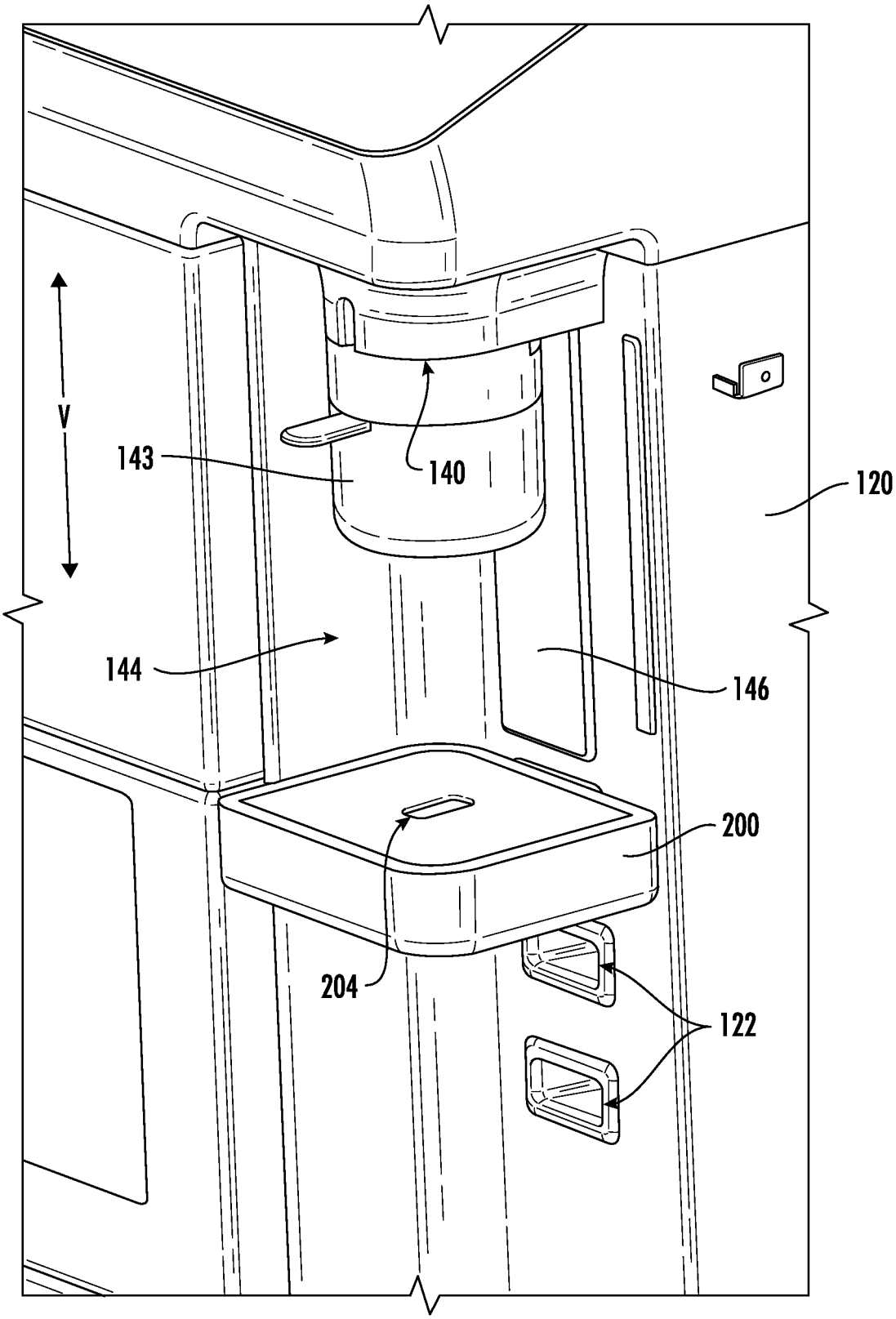
FIG. 2 is a partial perspective of the example free-standing appliance of FIG. 1.

As shown in FIG. 2, free-standing appliance 100 also includes a drip tray 200. Drip tray 200 is mountable to housing 120 at dispenser recess 144. A cup or other container may be positioned on drip tray 200 below outlets 140. Thus, drip tray 200 may support the container in dispenser recess 144 below outlets 140. In addition, drip tray 200 may define an interior volume 202. A top of drip tray 200, on which containers sit, may define one or more openings 204 for liquids to pass through the top of drip tray 200 into interior volume 202. Thus, liquids from outlets 140, such as drips, overflows, spills, etc. may flow into interior volume 202, e.g., rather than flowing onto a floor below appliance 100.

As discussed in greater detail below, drip tray 200 may be mounted at various heights within dispenser recess 144. In particular, housing 120 may define a plurality of mounting pockets 122 at dispenser recess 144 below outlets 140. In certain example embodiments, mounting pockets 122 may include no less than three mounting pockets. Moreover, mounting pockets 122 may include four, five, six, or more mounting pockets in certain example embodiments. Mounting pockets 122 may be distributed and spaced apart, e.g., along the vertical direction V.

Drip tray 200 may be installed on housing 120 at each of mounting pockets 122. Thus, the height of drip tray 200 within dispenser recess 144 may be adjusted to allow for various sized containers to be supported below outlets 140 on drip tray 200. Mounting pockets 122 may be spaced to accommodate various sized articles. For instance, a spacing, e.g., along the vertical direction V, between a topmost one of mounting pockets 122 and a bottommost one of mounting pockets 122 may be no less than eight centimeters (8 cm) in certain example embodiments. Moreover, the spacing between the topmost one of mounting pockets 122 and the bottommost one of mounting pockets 122 may be no less than ten centimeters (10 cm) and no greater than thirty centimeters (30 cm) in certain example embodiments. The spacing between adjacent mounting pockets 122 may also be selected to accommodate various sized articles. For example, each mounting pocket 122 may be spaced from an adjacent mounting pocket 122, e.g., along the vertical direction V, by no less than three centimeters (3 cm) in certain example embodiments. Moreover, each mounting pocket 122 may be spaced from an adjacent mounting pocket 122 along the vertical direction V by no less than five centimeters (5 cm) and no more than twenty centimeters (20 cm) in certain example embodiments.

Figure 3:
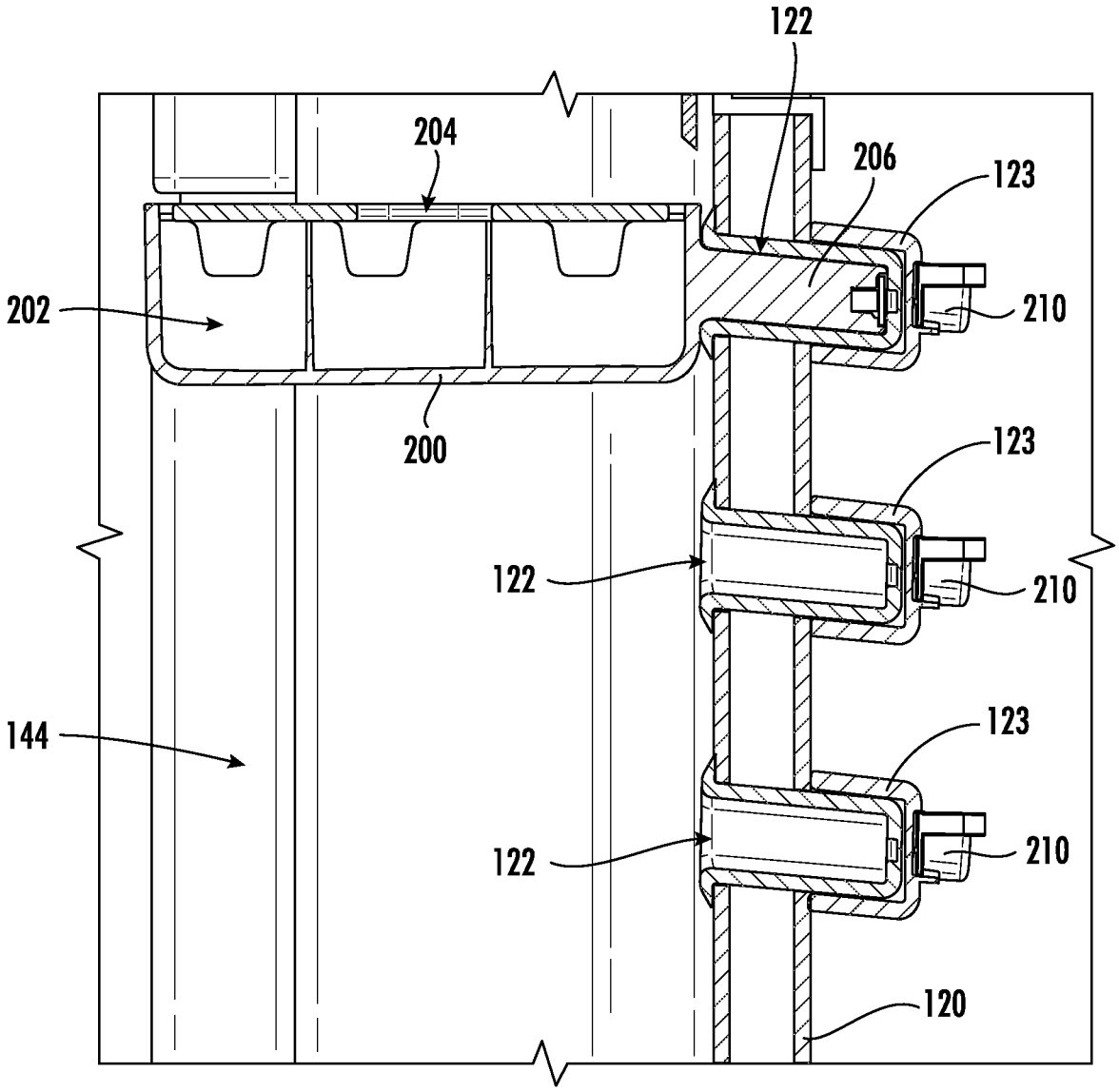
FIG. 3 is partial section view of a dispensing recess of the example free-standing appliance of FIG. 1.

To ensure that drip tray 200 is installed on housing 120 and thus available to catch spills in interior volume 202, appliance 100 also includes features for detecting whether drip tray 200 is installed on housing 120. As shown in FIG. 3, appliance 100 may include a plurality of sensors 210 disposed within housing 120. Each of sensors 210 may be positioned at a respective one of mounting pockets 122. Moreover, each of sensors 210 may be configured to detect when drip tray 200 is mounted at the respective one of mounting pockets 122. For example, each sensor 210 may detect when a portion of drip tray 200 is fully inserted into the respective one of mounting pockets 122 such that drip tray 200 is installed on housing 120. Sensors 210 may be plunger switches, magnetic switches, Hall effect sensors, etc.

Figure 4:
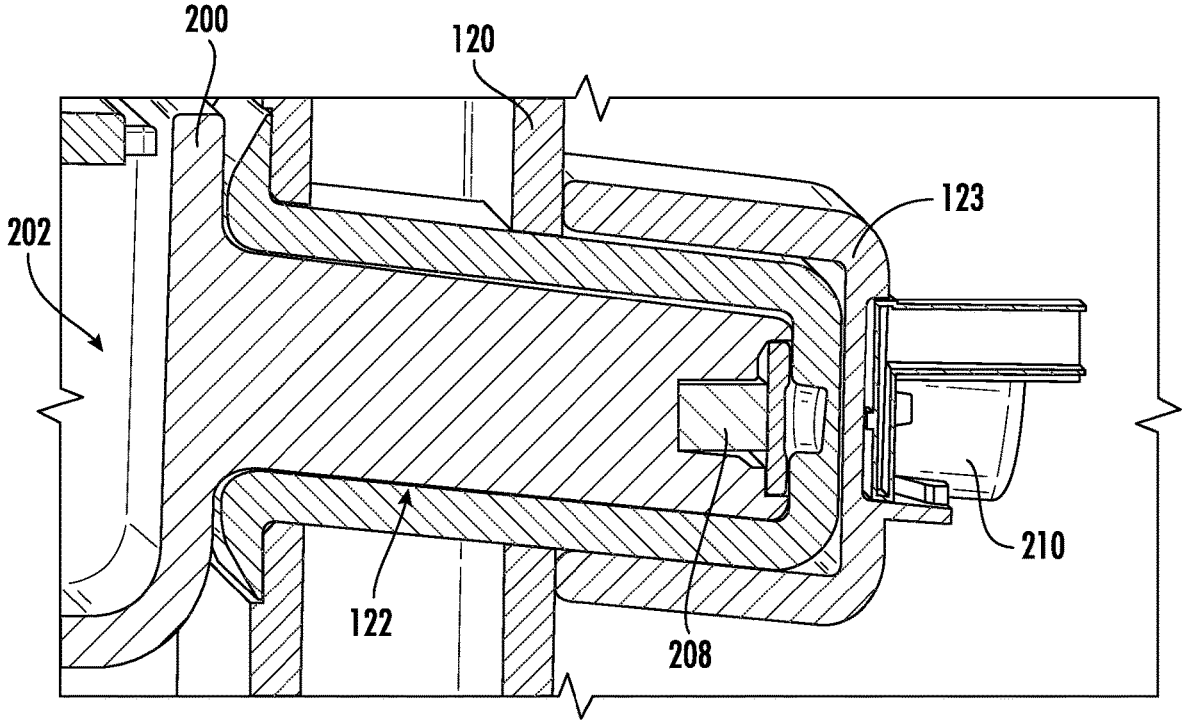
FIG. 4 is a partial section view of a drip tray and a mounting pocket of the example iced coffee module of FIG. 3.
Figure 5:
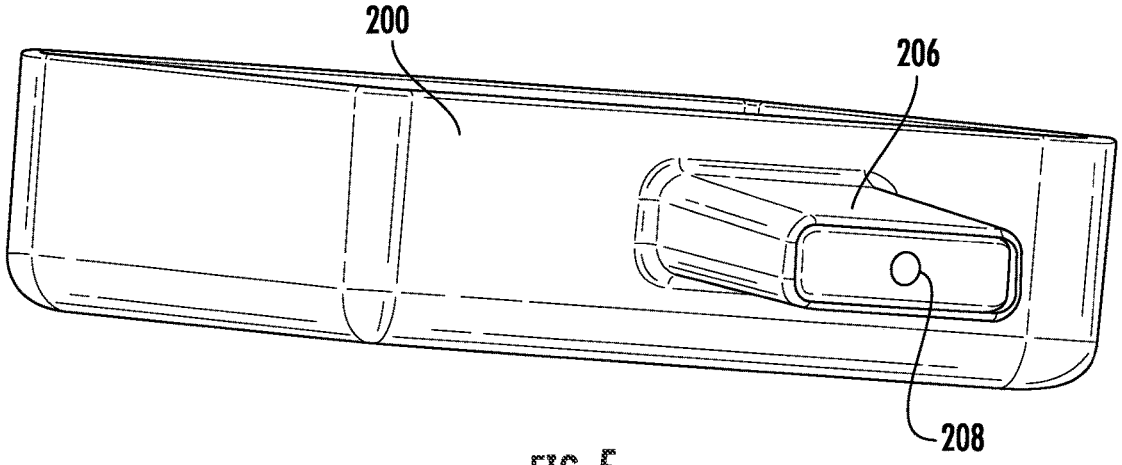
FIG. 5 is a rear perspective view of the drip tray.

As shown in FIGS. 4 and 5, drip tray 200 may include a post 206. Post 206 is insertable into each of mounting pockets 122. In particular, drip tray 200 may be mounted to housing 120 in dispensing recess 144 by inserting post 206 into one of mounting pockets 122 as shown in FIG. 3. Drip tray 200 may further include a magnet 208. Magnet 208 may be disposed within post 206, e.g., at a distal end portion of post 206. Thus, a magnetic field of magnet 208 may engage or interact with the respective one of sensors 210 that is positioned adjacent the one of mounting pockets 122 into which post 206 inserted by a user of appliance 100. When one of sensors 210 is triggered by magnet 208, the mounting of drip tray 200 within dispensing recess 144 may be confirmed. Magnet 208 may also engage with a ferro-magnetic material 123, such as mild steel, within mounting pockets 122 to assist with mounting drip tray 200 to housing 120. For instance, the magnetic field from magnet 208 may engage the ferro-magnetic material 123 within mounting pockets 122 to assist with drawing post 206 into mounting pockets 122 and/or holding post 206 within mounting pockets 122.

Other features of drip tray 200 may assist with mounting of drip tray 200 to housing 120. For example, post 206 may also be angled downwardly, e.g., such that the distal end of post 206 is positioned lower than the proximal end of post 206 when post 206 is received within one of mounting pockets 122 and drip tray 200 is mounted to housing 120. Such angling of post 206 may also assist with holding drip tray 200 on housing 120 and limiting inadvertent detachment of drip tray 200 from housing 120.

Figure 6:
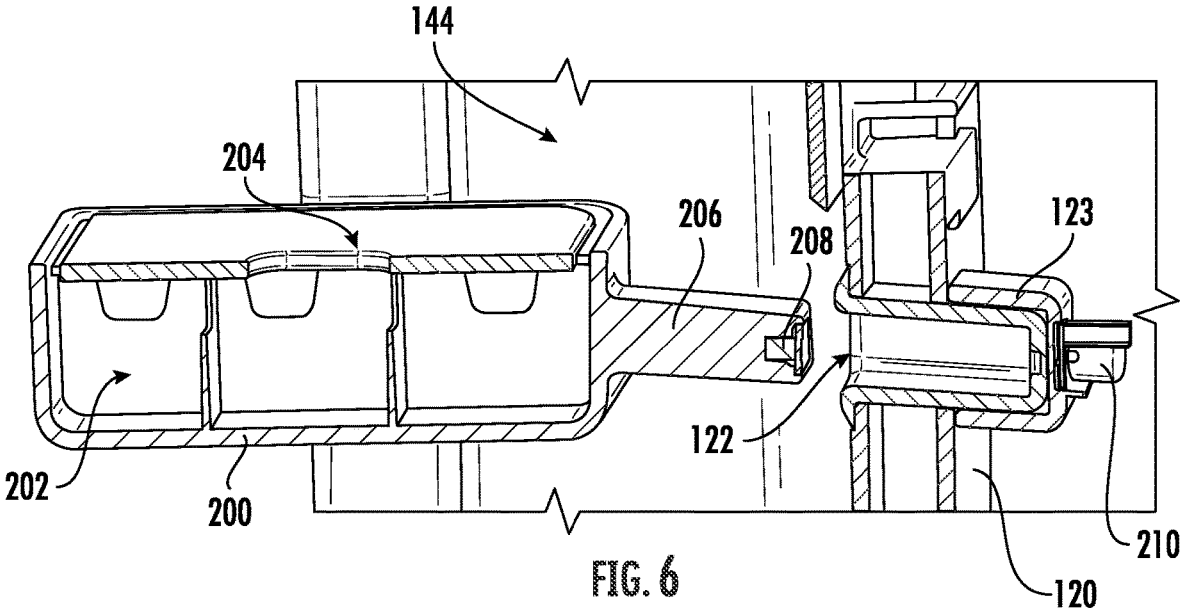
FIGS. 6 and 7 are partial section view of the drip tray and the mounting pocket during mounting of the drip tray at the mounting pocket.
Figure 7:
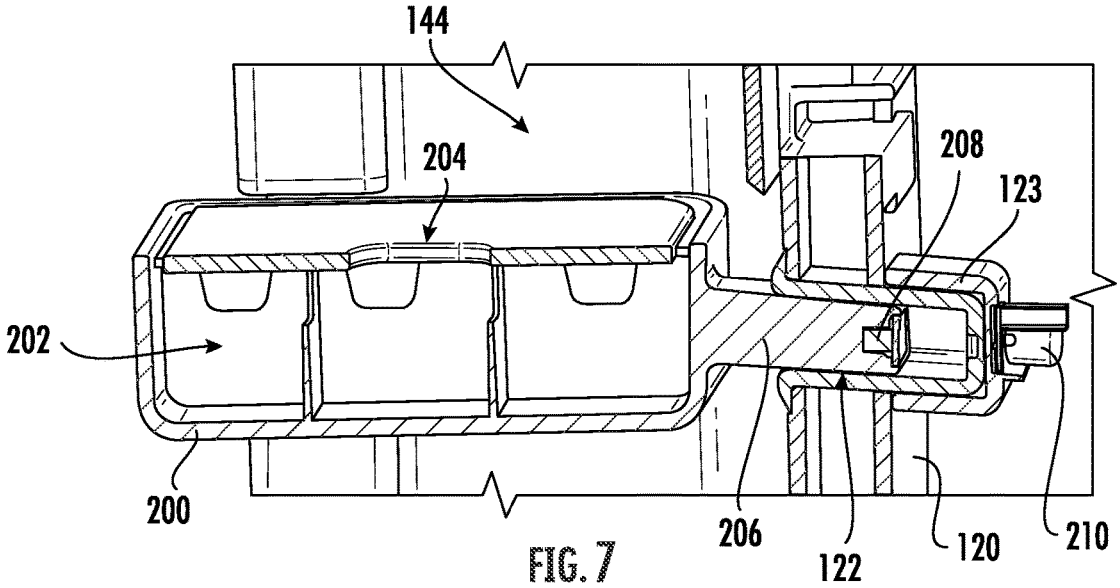

Appliance 100 may include features for limiting operation of delivery assembly 142 when drip tray 200 is not properly installed on housing 120. For instance, when drip tray 200 is removed from housing 120 as shown in FIG. 6 and/or post 206 is only partially inserted into mounting pocket 122 as shown in FIG. 7, sensor 210 does not detect drip tray 200, and controller 152 may deactivate delivery assembly 142 to prevent dispensing until drip tray 200 is installed. Conversely, when drip tray 200 is installed on housing 120, e.g., such that post 206 is fully inserted into mounting pocket 122 as shown in FIG. 4, sensor 210 may detect drip tray 200, and controller 152 may activate delivery assembly 142 to allow dispensing.

By detecting the presence of drip tray 200, dispensing of appliance 100, e.g., during an autofill function of appliance 100, can be easier and/or cleaner. For various reasons, the drip tray 200 can be removed or misinstalled on appliance 100. Sensors 210 can prevent operation of the autofill features in such situations and thereby advantageously avoid large liquid spills.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A beverage dispenser, comprising:

a casing defining a dispensing recess and a plurality of mounting pockets, the plurality of mounting pockets distributed along a vertical direction at the dispensing recess;

a fluid conduit disposed within the casing, an outlet of the fluid conduit disposed above the dispensing recess of the casing;

a drip tray mountable to the casing at each of the plurality of mounting pockets, the drip tray comprising a post insertable into each of the plurality of mounting pockets in order to mount the drip tray to the casing within the dispensing recess, the post comprising a magnet disposed within the post at a distal end portion of the post; and a plurality of sensors disposed within the casing, each of the plurality of sensors positioned at a respective one of the plurality of mounting pockets, each of the plurality of sensors configured to detect when the drip tray is mounted at the respective one of the plurality of mounting pockets.

2. The beverage dispenser of claim 1, wherein the plurality of mounting pockets comprises no less than three mounting pockets.

3. The beverage dispenser of claim 2, wherein each of the plurality of mounting pockets is spaced from an adjacent mounting pocket by no less than three centimeters along the vertical direction.

4. The beverage dispenser of claim 1, wherein the plurality of sensors comprises a plurality of Hall effect sensors.

5. The beverage dispenser of claim 1, wherein the drip tray comprises a post insertable into each of the plurality of mounting pockets in order to mount the drip tray to the casing within the dispensing recess.

6. The beverage dispenser of claim 5, wherein the drip tray further comprises a magnet disposed within the post at a distal end portion of the post.

7. The beverage dispenser of claim 6, wherein the plurality of sensors comprises a plurality of Hall effect sensors.

8. The beverage dispenser of claim 1, further comprising a single-serve brewing module mountable to the casing at the outlet of the fluid conduit.

9. The beverage dispenser of claim 1, wherein a spacing between a topmost one of the plurality of mounting pockets and a bottommost one of the plurality of mounting pockets is no less than eight centimeters.

10. A beverage dispenser, comprising:

a casing defining a dispensing recess and a plurality of mounting pockets, the plurality of mounting pockets distributed along a vertical direction at the dispensing recess;

a fluid conduit disposed within the casing, an outlet of the fluid conduit disposed above the dispensing recess of the casing;

a drip tray mountable to the casing at each of the plurality of mounting pockets such that a magnet within the drip tray is disposed within the respective mounting pocket, the drip tray comprising a post insertable into each of the plurality of mounting pockets in order to mount the drip tray to the casing within the dispensing recess, the magnet disposed within the post at a distal end portion of the post; and a plurality of magnetic sensors disposed within the casing, each of the plurality of magnetic sensors positioned at a respective one of the plurality of mounting pockets, each of the plurality of magnetic sensors configured to detect the magnet when the drip tray is mounted at the respective one of the plurality of mounting pockets.

11. The beverage dispenser of claim 10, wherein the plurality of mounting pockets comprises no less than three mounting pockets.

12. The beverage dispenser of claim 11, wherein each of the plurality of mounting pockets is spaced from an adjacent mounting pocket by no less than three centimeters along the vertical direction.

13. The beverage dispenser of claim 10, wherein the plurality of magnetic comprises a plurality of Hall effect sensors.

14. The beverage dispenser of claim 10, wherein the drip tray comprises a post insertable into each of the plurality of mounting pockets in order to mount the drip tray to the casing within the dispensing recess.

15. The beverage dispenser of claim 14, wherein the magnet is disposed within the post at a distal end portion of the post.

16. The beverage dispenser of claim 10, wherein the plurality of magnetic sensors comprises a plurality of Hall effect sensors.

17. The beverage dispenser of claim 10, further comprising a single-serve brewing module mountable to the casing at the outlet of the fluid conduit.

18. The beverage dispenser of claim 10, wherein a spacing between a topmost one of the plurality of mounting pockets and a bottommost one of the plurality of mounting pockets is no less than eight centimeters.

19. The beverage dispenser of claim 1, further comprising a ferro-magnetic material within each of the plurality of mounting pockets to assist with holding post within the respective mounting pocket, wherein the post is angled downwardly such that the distal end of the post is positioned lower than a proximal end when the post is received within one of the respective mounting pockets.

20. The beverage dispenser of claim 11, further comprising a ferro-magnetic material within each of the plurality of mounting pockets to assist with holding post within the respective mounting pocket, wherein the post is angled downwardly such that the distal end of the post is positioned lower than a proximal end when the post is received within one of the respective mounting pockets.

* * * * *